US008100138B2

(12) United States Patent
Gueret

(10) Patent No.: US 8,100,138 B2
(45) Date of Patent: Jan. 24, 2012

(54) APPLICATOR FOR APPLYING COMPOSITION TO EYELASHES AND/OR EYEBROWS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 729 days.

(21) Appl. No.: 12/213,661

(22) Filed: Jun. 23, 2008

(65) Prior Publication Data

US 2009/0133707 A1 May 28, 2009

Related U.S. Application Data

(60) Provisional application No. 60/948,583, filed on Jul. 9, 2007.

(30) Foreign Application Priority Data

Jun. 22, 2007 (FR) ..... 07 55953

(51) Int. Cl.
*A45D 40/26* (2006.01)

(52) U.S. Cl. ..... 132/320; 132/218

(58) Field of Classification Search ..... 132/141, 132/142, 139, 126, 217–218, 318, 320; 401/121, 401/129; 15/207.2, 236.08
See application file for complete search history.

(56) References Cited

U.S. PATENT DOCUMENTS

| | | | | |
|---|---|---|---|---|
| 6,343,607 | B1 * | 2/2002 | Gueret | 132/218 |
| 6,412,496 | B1 | 7/2002 | Gueret | |
| 6,446,637 | B2 | 9/2002 | Gueret | |
| 6,539,950 | B1 | 4/2003 | Gueret | |
| 6,546,937 | B2 | 4/2003 | Gueret | |
| 6,581,610 | B1 | 6/2003 | Gueret | |
| 6,866,046 | B2 | 3/2005 | Gueret | |
| 7,467,905 | B2 | 12/2008 | Habatjou | |
| 2001/0037815 | A1 | 11/2001 | Gueret | |
| 2001/0047808 | A1 | 12/2001 | Gueret | |
| 2002/0020424 | A1 | 2/2002 | Gueret | |
| 2003/0213498 | A1 | 11/2003 | Gueret | |
| 2004/0011375 | A1 * | 1/2004 | Dumler | 132/218 |
| 2005/0046087 | A1 | 3/2005 | De Laforcade | |
| 2005/0249539 | A1 | 11/2005 | Habatjou | |
| 2006/0002758 | A1 | 1/2006 | Gueret | |
| 2006/0056903 | A1 | 3/2006 | Gueret | |

FOREIGN PATENT DOCUMENTS

| | | |
|---|---|---|
| EP | 1 070 465 A3 | 1/2001 |
| EP | 1 070 467 A2 | 1/2001 |
| EP | 1 342 428 A1 | 9/2003 |
| EP | 1 593 320 A1 | 11/2005 |
| EP | 1 611 817 A1 | 1/2006 |
| EP | 1 632 149 A3 | 3/2006 |
| WO | WO 97/28719 | 8/1997 |

* cited by examiner

OTHER PUBLICATIONS

French Search Report for FR 0755953, dated Feb. 4, 2008.

*Primary Examiner* — Todd Manahan
*Assistant Examiner* — Brianne O'Neill
(74) *Attorney, Agent, or Firm* — Finnegan, Henderson, Farabow, Garrett & Dunner LLP

(57) ABSTRACT

An applicator enables a composition to be applied to the eyelashes and/or the eyebrows. The applicator may include an applicator member including a core defining faces, and rows of applicator elements connected to the core. The rows of applicator elements may include at least a first row including applicator elements connected to the core via a respective bend portion. The applicator elements in the first row may include at least one applicator element including a main portion extending substantially parallel to a face of the core underlying and facing the main portion. The main portion may be situated between the bend portion and a free end of the at least one applicator element.

40 Claims, 3 Drawing Sheets

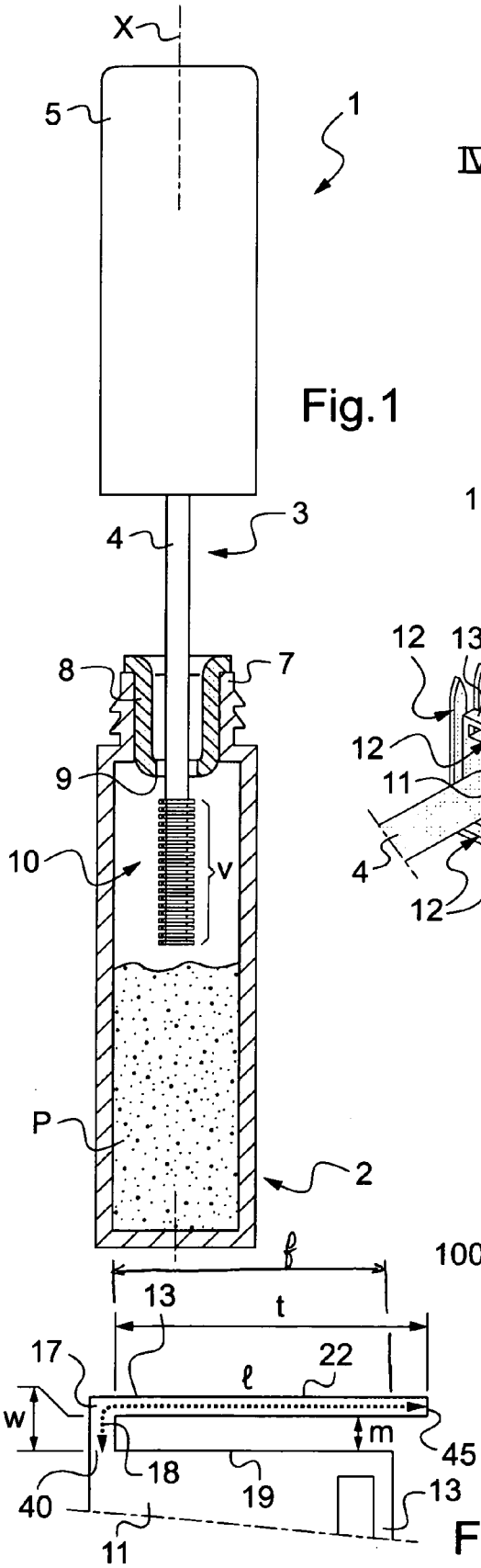
Fig.1
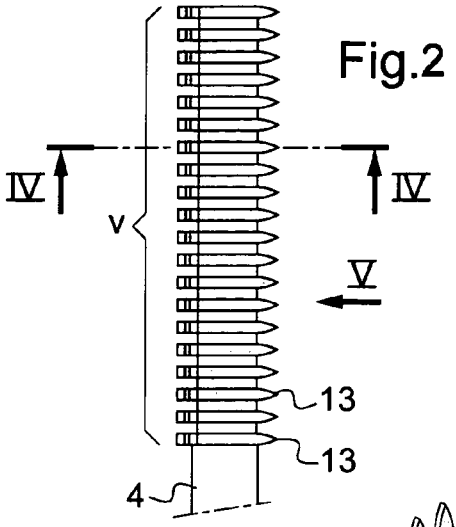
Fig.2
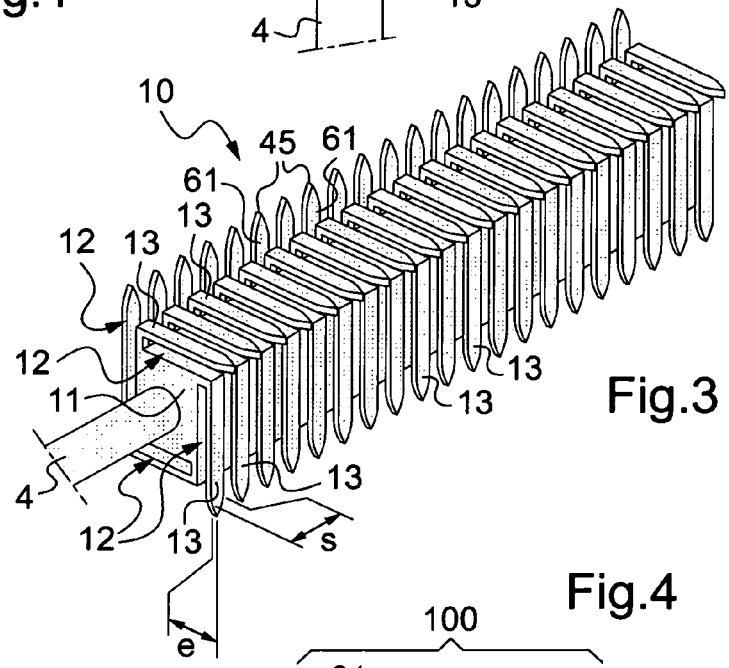
Fig.3
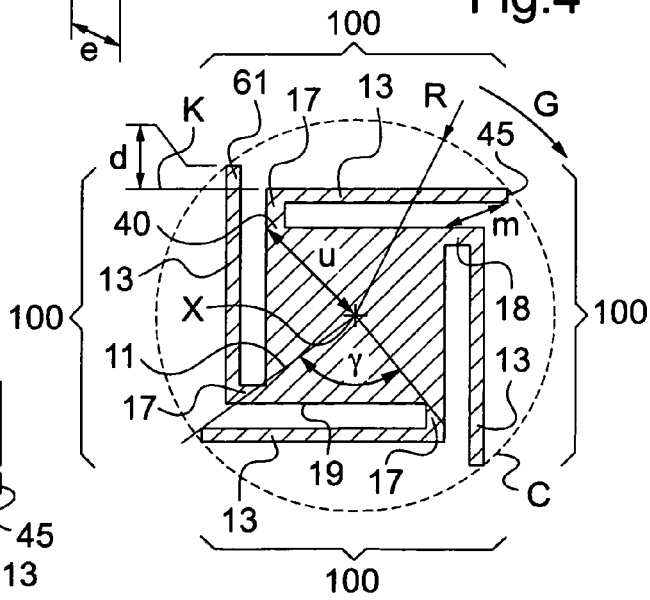
Fig.4
Fig.5

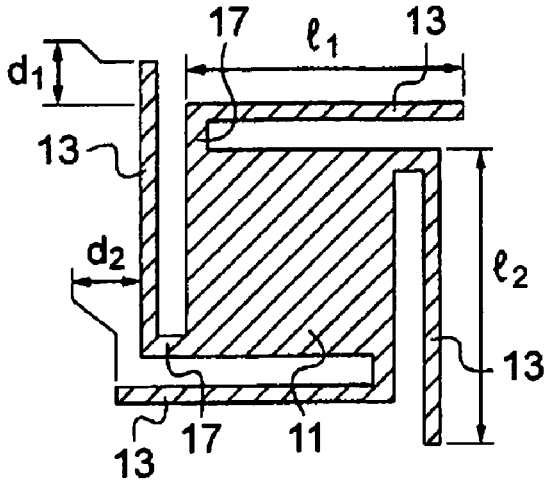
Fig.18
Fig.19
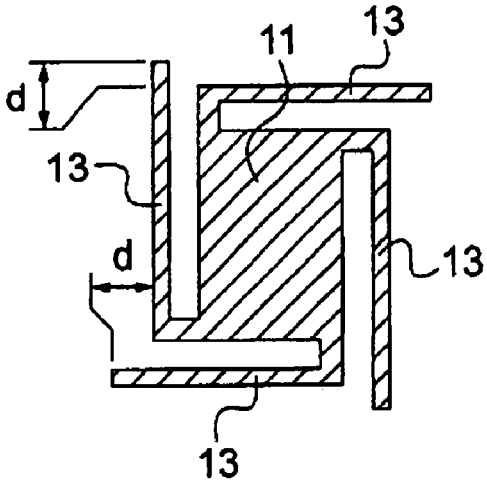
Fig.20
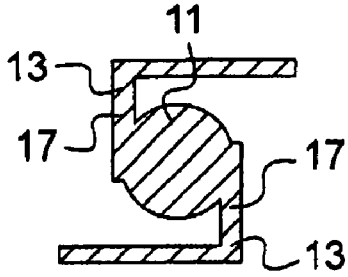
Fig.21
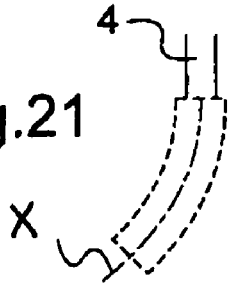
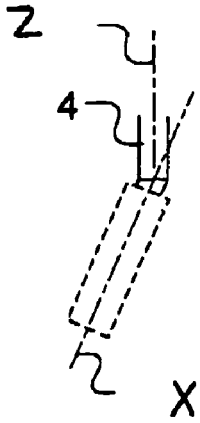
Fig.22

APPLICATOR FOR APPLYING COMPOSITION TO EYELASHES AND/OR EYEBROWS

This application claims benefit of U.S. Provisional Application No. 60/948,583, filed Jul. 9, 2007. This application also claims benefit of priority under 35 U.S.C. §119 to French Patent Application No. FR 0755953, filed Jun. 22, 2007.

The present invention relates to applicators for applying a composition to the eyelashes and/or the eyebrows, and more particularly to applicators including an applicator member comprising a core and applicator elements connected to the core. The applicator elements, which may be bristles or teeth depending on how rigid they are, can be made integrally with the core, in particular by molding. Such applicator members may be injection-molded brushes or combs.

DESCRIPTION OF RELATED ART

Numerous applicators are known, such as those disclosed in, e.g., U.S. Application Publication No. 2006/0056903, European Patent Application Nos. 1 342 428, 1 070 467, and 1 593 320, and U.S. Pat. No. 6,343,607.

In a large number of injection-molded brushes, the bristles are connected substantially perpendicularly to the core and are relatively short since the applicator member must generally be able to pass without too much difficulty through a wiper member included in the receptacle containing the composition. The short length of the applicator elements and the way they are oriented can limit the quantity of composition deposited on the eyelashes. For example, composition can be applied with bristle or teeth ends that are loaded with very little composition, since they are wiped thoroughly.

In addition, short bristles tend to be more rigid and to brush more rigorously, tending to take back composition deposited on the eyelashes.

In use, such brushes or combs have been found not to be optimized, at least for some composition rheologies.

Patent-related publications, such as, e.g., WO 97/28719, EP 1 632 149, EP 1 611 817, and EP 1 070 465, disclose combs for applying makeup to the eyelashes and/or the eyebrows.

SUMMARY

The present disclosure seeks to provide an improvement as compared to at least some applicators for applying a composition to the eyelashes and/or the eyebrows, e.g., with a view to applying a relatively large amount of composition to the eyelashes and/or the eyebrows while separating them.

In one of its aspects, the invention provides an applicator for applying a composition to the eyelashes and/or the eyebrows, the applicator comprising an applicator member comprising a core and applicator elements that are connected to the core. The term "applicator elements," as used herein, should be understood to mean elements that are individualized and that are used for application. In addition, the term "connected" (and similar forms of the term "connected," such as "connect," "connection," etc.), as used herein, should be understood to encompass both a plurality of separate parts that have been joined or fastened together and a unitary, one piece arrangement having different parts. Accordingly, one example of applicator elements connected to a core would be applicator elements that have been joined or fastened to a core, and another example of applicator elements connected to a core would be a single, unitary piece of material (e.g., molded plastic) defining both the applicator elements and the core.

In at least some embodiments, the applicator for applying a composition to the eyelashes and/or the eyebrows may comprise an applicator member including a core defining faces, and rows of applicator elements connected to the core. At least a first row may comprise applicator elements connected to the core via a respective bend portion. At least one of the applicator elements may comprise a main portion that extends substantially parallel to a face of the core that underlies and faces the main portion. The main portion may be situated between the bend portion and a free end of the at least one applicator element.

The term "substantially parallel to the face" should be understood to mean that an applicator element extends in a main direction that defines an angle with respect to the corresponding, underlying face of the core, which is less than 20°, or less than 15°, or less than 10°, or less than 5°, or that the main direction and the corresponding, underlying face of the core are strictly parallel.

The term "bend" or "bend portion" should be understood to mean a portion that clearly changes direction on going along the applicator element from the core towards a free end of the applicator element. At least one applicator element, or half or all of the applicator elements, may have a respective bend portion which may bend through at least 60°, or substantially through 90°. The bend portions may thus bend substantially at right angles.

The bend portion may comprise a first branch via which the applicator element is connected to the core, and a second branch that extends towards the free end of the applicator element, the first branch extending over a distance lying in the range of 0.2 millimeters (mm) to 3 mm, for example. All of the branches that are connected to the core of the applicator elements in any one row may be of the same length, so that the corresponding applicator elements are all situated at the same level. In a variant, the first branches of the applicator elements of a row may be of different lengths, so that the corresponding applicator elements lie at a plurality of levels.

An applicator member of the present disclosure may have applicator elements that are relatively long, but without that unduly hindering passage through a wiper member.

In at least some embodiments, composition may be applied using tangential contact between the applicator elements and the eyelashes, which facilitates covering the eyelashes with composition.

At least some embodiments can promote extensive contact between an applicator element and an eyelash (i.e., contact that is not confined to only a point), the applicator element having, for example, a portion that is oriented substantially parallel to the eyelash during application.

By way of example, at least some embodiments may make it possible to cover the eyelashes with composition by guiding them to take up composition between applicator elements, along the length of the applicator elements, and not only at their ends.

In some examples, the relatively long length of the applicator elements can impart flexibility thereto, and that can increase comfort in use and/or make it easier to pass through the wiper member.

Finally, some examples of the applicator member may be suitable for retaining a relatively large quantity of composition between the applicator elements and the core, the core possibly being protected against being wiped thoroughly by the applicator elements, when said applicator elements extend all around the core.

The orientation of the applicator elements relative to the wiper member also may modify the distribution of the composition over the applicator member compared to a conventional applicator member having radial applicator elements.

In some embodiments of the invention, at least one applicator element extends (or all of the applicator elements of a row of applicator elements extend) at least partially around the core with its free end (or its entire length other than where it is connected to the core) being spaced apart from said core by a distance that is less than or equal to half of its length, or even less, e.g., less than or equal to one fourth of its length. The above-mentioned distance is measured in a plane that is perpendicular to the longitudinal axis of the applicator member.

The applicator member may have at least one face, or even two, three, four, or more faces, that is/are used for application, each face being at least defined by at least a portion of the applicator elements of one row, and by at least free ends of applicator elements of another row.

The term "application face" should be understood to mean a region of the applicator member that is suitable for being brought into contact with the eyelashes during application.

The core may define faces, and the rows of applicator elements may have main portions that extend substantially parallel to an underlying corresponding face of the core.

The core may have a cross-section presenting a shape that is substantially polygonal, and said main portion of said applicator element may be substantially rectilinear.

At least a first applicator element of one row may be situated level with a second applicator element of another row or may extend beyond it, and a plane that is perpendicular to the longitudinal axis of the first applicator element may intersect the second applicator element without passing through the core. This may make it possible to comb the eyelashes with one row of applicator elements while the other row deposits the composition on the eyelashes.

At least one applicator element of a row may have a main portion that extends substantially parallel to a face of the core that underlies and faces the main portion. The length of the main portion that extends substantially parallel to an underlying face of the core may be greater than or equal to one fourth of the total length of the applicator element. Each applicator element of a row may have a main portion that extends substantially parallel to an underlying face of the core.

In some embodiments of the invention, the applicator member presents, over at least a fraction of its length, a cross-section that defines an envelope circle that circumscribes the applicator member. At least one applicator element along said portion may have a length that is greater than or equal to the radius of the envelope circle, and may have a free end that is spaced apart from the core by a distance that is less than or equal to half the radius of the envelope circle, in particular in all points.

All along its length (other than where it is connected to the core), at least one applicator element may be spaced apart from the core by a distance that is not greater than half the radius of the envelope circle.

The length of at least one applicator element may be greater than or equal to two-thirds of the diameter of the above-mentioned envelope circle.

The applicator member may have a distal end that tapers, thereby making it easier to put the applicator member back into the receptacle.

The applicator elements may remain relatively close to the core, e.g., being spaced apart from the core by a distance that is not greater than one third of the radius of the envelope circle, or even one fourth of the radius of the envelope circle.

The envelope circle may be centered on the longitudinal axis of the core, the longitudinal axis of the core being the axis that passes via the centers of gravity of the cross-sections of the core.

The above-mentioned portion of the applicator member may be of length that is equal to at least half the total length of the applicator member, or it may even be of equal length, with all of the applicator elements presenting the above-mentioned characteristics, for example.

The core may be symmetric about an axis of symmetry that coincides with the longitudinal axis of the core. The cross-section of the core may have a shape that is substantially polygonal. The cross-section of the core may be square, oval, or circular, amongst others.

The core may have a longitudinal axis that is optionally rectilinear.

The applicator may comprise at least two rows of applicator elements, or at least three rows of applicator elements, having applicator elements that extend at least partially around the longitudinal axis of the core in the same direction.

The applicator may comprise at least two rows of applicator elements, and at least fractions of the applicator elements of one row may cross a plane that is tangential to at least one applicator element of another row, the tangential plane being perpendicular to a radius passing via the longitudinal axis of the core. This crossed configuration may make it possible to use the applicator elements that are parallel to the eyelashes for covering the eyelashes with composition, and the projecting ends for separating the eyelashes, the user possibly using the ends as a mini comb. When the applicator member is observed from the side, perpendicularly to its longitudinal axis, at least one applicator element belonging to a row of applicator elements may project beyond at least one applicator element of an adjacent row of applicator elements, e.g., by at least 0.5 mm.

At least one applicator element, or most or all of the applicator elements, may be connected substantially perpendicularly to a corresponding face of the core.

At least one applicator element, or most or all of the applicator elements, may have a main portion of a longitudinal axis that is substantially parallel to a corresponding face of the core. The length of the main portion that extends substantially parallel to a underlying face of the core may be greater than or equal to one fourth, or greater than or equal to half, of the total length of the applicator element.

The main portion of the applicator element extending substantially parallel to the underlying face of the core may have a length which is strictly greater than a dimension of the face of the core underlying and facing the main portion.

At least one applicator element, or most or all of the applicator elements, may comprise a base that is spaced apart from the longitudinal axis of the core by at least one eighth or one sixth, or even one fourth, of the radius of the envelope circle. The bases may be off-center relative to the longitudinal axis of the core, thereby making it easier for the applicator elements to be long.

The applicator member may comprise a row of at least six applicator elements. All of the rows may comprise at least six or fifteen applicator elements.

By way of example, the number of rows in an applicator member may lie in the range of one to eight. By way of example, the spacing between two consecutive applicator elements of a row may be small enough for the composition to be retained between the applicator elements after passing through the wiper member. The applicator elements of the various rows may occupy the same positions along the longitudinal axis of the core, or they may be offset.

The applicator elements may be made integrally with the core, and they may be made out of the same material or out of a different material, e.g., a material that is more flexible or less flexible. All of the applicator elements may be molded integrally with the core. Where appropriate, the applicator may be made from natural plant products.

The applicator member may define an envelope surface of cross-section that is substantially constant over at least half the length of the fraction of the applicator member that carries the applicator elements.

The length of at least one applicator element, or of most or all of the applicator elements, may be greater than or equal to 1.5 mm, e.g., lying in the range of 1.5 mm to 10 mm, or in the range of 3 mm to 7 mm.

The applicator member may comprise at least one applicator element that extends angularly about the longitudinal axis of the core over at least 45°, or over at least 60°, 70°, or 90°.

At least one applicator element may be perforated, thereby increasing the flexibility of the applicator element and/or favoring retention of composition, for example.

The applicator elements may present various shapes in cross-section, e.g., shapes that are solid or hollow, and optionally circular, polygonal, trapezoidal, or flat, amongst others. The applicator elements may be of thickness that is optionally constant. The applicator elements may include roughness and/or include a particle filler. The applicator may include magnetizable particles. The applicator may be flocked.

All of the applicator elements of a single row may optionally have the same length. The applicator elements may have bases that are spaced apart or that are joined together.

At least one applicator element may present an undulating shape, the undulation occurring, for example, along any axis, e.g., lying in a plane that is perpendicular to the longitudinal axis of the core, or in a plane that is parallel to the longitudinal axis of the core.

The applicator elements may form blades that are wider than they are thick, the dimension corresponding to their width being parallel to the longitudinal axis of the core, and that can contribute to creating a preferred direction of deformation for the applicator elements, going away from or towards the core.

At least one applicator element may present a free end that is bent, abraded, or wide. The end may form a bead or a fork, for example.

At least two applicator elements may cross, the applicator elements belonging to the same row of applicator elements, for example.

The applicator element may be connected to a stem that may be connected to a handle. The handle may be configured to close a receptacle containing the composition for application.

In some embodiments of the invention, the applicator for applying a composition to the eyelashes and/or the eyebrows may comprise an applicator member comprising a core and rows of applicator elements that are connected to the core, at least a first row, or each row, comprising applicator elements that are connected to the core via a bend portion, the applicator member having at least one face that is used for application and that is at least defined by at least a portion of the applicator elements of the first row, and by at least free ends of the applicator elements of another row.

In another of its aspects, the present disclosure may include a packaging and applicator device, comprising any of the applicators described herein and a composition for application to the eyelashes or the eyebrows.

The composition may be contained in a receptacle that is provided with a wiper member.

Another aspect of the present disclosure also provides a method of applying makeup to the eyelashes or the eyebrows, the method comprising bringing an applicator as described herein into contact with the eyelashes, at least one applicator element extending tangentially relative to at least one eyelash or eyebrow, and/or contact with the eyelashes and/or eyebrows being made with at least two applicator elements belonging to adjacent rows.

The present disclosure also provides an applicator for applying a composition to the eyelashes and/or the eyebrows, the applicator including an applicator member comprising a core and at least one applicator element that is connected to the core, the applicator element extending at least partially around the core with its free end being spaced apart from said core by a distance that is less than or equal to one fourth of the length of the applicator element, the distance being measured in a plane that is perpendicular to the longitudinal axis of the applicator member.

Still another aspect of the present disclosure provides an applicator for applying a composition to the eyelashes and/or the eyebrows, the applicator including an applicator member comprising a core of polygonal cross-section, and applicator elements having rectilinear portions that extend facing and parallel to a corresponding face of the core.

In another of its aspects, the invention also provides an applicator for applying a composition to the eyelashes and/or the eyebrows, the applicator including an applicator member comprising a core and rows of applicator elements that are connected to the core. The applicator elements of at least one row extend over a face of the core. By way of example, the applicator elements of one row extend over an angular sector of at least 60°, 70° or 90°, about the longitudinal axis of the core. Each of the applicator elements may include a bend portion via which they are connected to the core.

In some aspects, the present disclosure provides an applicator for applying a composition to the eyelashes and/or the eyebrows, the applicator including an applicator member, the applicator member comprising a core and applicator elements that are connected to the core, the applicator member presenting, over at least a fraction of its length, a cross-section that defines an envelope circle that circumscribes the applicator member, at least one applicator element along said fraction having a length that is greater than or equal to the radius of the envelope circle, and having a free end that is spaced apart from the core by a distance that is less than or equal to half the radius of the envelope circle.

BRIEF DESCRIPTION OF THE DRAWINGS

Some of the exemplary features of invention can be better understood on reading the following detailed description of non-limiting embodiments thereof, and on examining the accompanying drawings.

FIG. 1 is a diagrammatic view, partially in longitudinal section, showing a packaging and applicator device constituting an embodiment of the invention;

FIG. 2 shows the FIG. 1 applicator member in greater detail;

FIG. 3 is a fragmentary and diagrammatic perspective view of the FIG. 1 applicator member;

FIG. 4 is a cross-section on IV-IV in FIG. 2;

FIG. 5 is a view of an applicator element of the applicator member in FIGS. 1 to 4, shown in isolation;

FIGS. 16 to 20 are diagrammatic cross-sections of other variant embodiments of the applicator member; and FIGS. 21 and 22 show applicator members respectively with a longitudinal axis that is curved and with a longitudinal axis that slopes relative to the longitudinal axis of the stem.

MORE DETAILED DESCRIPTION

Figure 6:
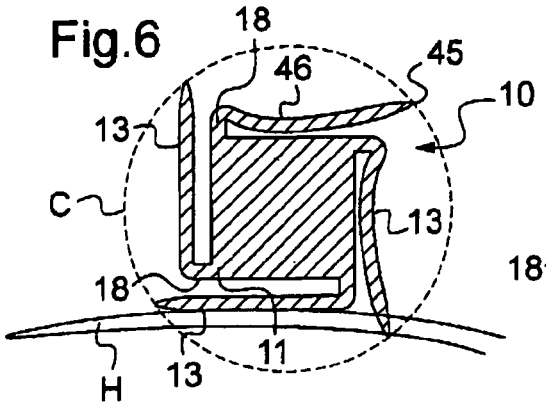
FIG. 6 is a view similar to FIG. 4 showing a variant embodiment.

The packaging and applicator device 1 shown in FIG. 1 comprises an applicator 3, and a receptacle 2 containing a composition for application to the eyelashes and/or the eyebrows, e.g., a mascara or a care product for the eyelashes.

The mascara can have any formulation.

The applicator 3 comprises a stem 4 that carries, at one end, an applicator member 10, and that is connected at the opposite end to a handle 5 that also constitutes a closure cap for closing the receptacle 2.

In the example shown, the top of the receptacle 2 includes a threaded neck 7, and the handle 5 is arranged so as to be screwed on the neck 7. The neck houses a wiper member 8 that can be of any kind, and can for example include a wiper lip that is made of a material that is relatively flexible and that defines a wiper orifice 9, e.g., a circular orifice.

When the applicator 3 is in place on the receptacle 2, the receptacle is closed in leaktight manner. While the applicator is being removed, the wiper member 8 wipes the stem 4 and the applicator member 10.

In the example shown, the stem 4 is rectilinear, but in a variant, said stem could be curved.

With reference to FIGS. 2 to 5, it can be seen that the applicator member 10 includes a core 11 that extends along a longitudinal axis that coincides with the longitudinal axis of the stem and of the rows 12 of application elements 13 that are connected to the core 11.

The applicator elements 13 can be made by molding integrally with the core 11, and can be made of the same material. In a variant, the applicator elements 13 can be overmolded on the core using a material that is different from said core.

The applicator elements 13 and/or the core 11 can be made of a thermoplastic material that can optionally be elastomer. For example, the material may be selected from: polyolefines, in particular polypropylene (PP), polyethylene (PE), polystyrene, polyethylene terephthalate (PET), polyoxymethylene (POM), polybutyl terephthalate (PBT), polyurethane (PU), polyvinyl chloride (PVC); silicone rubbers; nitrile rubbers; latex; butyl; ethylene-propylene terpolymer rubber (EPDM); styrene-ethylene-butylene-styrene (SEBS); styrene-isoprene-styrene (SIS); ethyl vinyl acetate (EVA); a polyether block amide; PEBAX®; HYTREL®; Sanotoprene; amongst others.

The applicator member 10 can be fitted on the stem 4 and to this end includes an endpiece, not shown in FIGS. 1 to 5, for inserting into a corresponding housing formed at the distal end of the stem 4. The endpiece can be fastened on the stem 4 by any means, e.g., by force-fitting, by snap-fastening, by adhesive, by screw-fastening, by heat-sealing, by crimping, and/or by stapling. The applicator member can also be fastened on the stem by inserting the stem 4 into a recess in the core.

In one example, the applicator member can be made by injecting a thermoplastic material through a core that is pierced so as to form the applicator elements.

In a variant, at least the core 11 of the applicator member 10 is made integrally with the stem 4, e.g., of the same material or of a different material.

In the example shown in FIGS. 1 to 3, the longitudinal axis X of the core 11 is rectilinear and coincides with the longitudinal axis of the stem 4. In some exemplary embodiments, the longitudinal axis of the core 11 may also form an angle with the longitudinal axis of the stem.

The core 11 can present various cross-sections, in particular a cross-section that is substantially polygonal, e.g., in the shape of a regular polygon, e.g., a square as shown in FIG. 3.

The number of rows 12 of applicator elements 13 can correspond to the number of faces of the core 11 when said core presents a cross-section that is polygonal.

All of the applicator elements 13 of a row 12 can be in alignment, e.g., being aligned along a straight line that is parallel to the longitudinal axis of the core. In a variant not shown, the applicator elements 13 of a row 12 may have bases 40 that are not in alignment, e.g., that are disposed alternately on either side of a separation surface.

Each of the applicator elements 13 can present a shape that tapers towards its free end.

The applicator elements 13 of the various rows 12 can occupy the same axial positions along the longitudinal axis X of the applicator member 10, as shown. In a variant not shown, at least two rows 12 have applicator elements that are offset along the longitudinal axis X.

All of the applicator elements 13 can extend at least partially around the axis of the core in the same direction G, as shown in FIG. 4 in particular.

FIG. 4 shows the envelope circle C that circumscribes the applicator elements 13. The envelope circle C is centered on the longitudinal axis X of the core 11 in the example under consideration. The envelope surface of the applicator member 10 can be circularly cylindrical about the axis X over at least a fraction v of its length.

The length l of at least one applicator element 13, or of at least most of the applicator elements 13, or of all of the applicator elements 13, can be greater than or equal to the radius R of the envelope circle C, and the applicator elements 13 can be spaced apart from the core by a relatively short distance, the greatest distance m between an applicator element 13 and the core 11 being less than or equal to half the radius R of the envelope circle C, for example. These values reflect the fact that the applicator element 13 extends around the core 11 over a distance that is relatively long, while remaining relatively close to said core. By way of example, the length l is greater than or equal to two-thirds of the diameter of the envelope circle.

The distance u from the base 40 of an applicator element 13 to the longitudinal axis X of the core 11 is greater than or equal to half the radius R, for example, as can be seen in FIG. 4.

In the example shown in FIGS. 1 to 5 in particular, the applicator elements 13 extend over a fraction v of the applicator member that corresponds to the entire portion of the applicator member carrying applicator elements. In some exemplary embodiments, the fraction v may extend over only part of the length of the portion of the applicator member carrying applicator elements, the applicator member being suitable for including, e.g., over a proximal or distal portion, other applicator elements such as applicator elements that extend purely radial.

At least one applicator element 13 can extend about the longitudinal axis X of the core 11 over an angle γ of at least 45°, or at least 60°, as shown in FIG. 4.

Each of the applicator elements 13 can be connected to the core 11 forming a bend portion 17, as shown in FIG. 4 in particular.

The bend portion 17 can have a branch 18 having an end that is connected to the core that defines the base 40 of the applicator element 13. The branch 18 can be oriented substantially perpendicularly to the face 19 of the core 11 to which the bend portion 17 is connected.

The bend portion 17 can have a bend of angle that is greater than 60°, e.g., close to 90°, as in the embodiment shown in FIG. 5.

The length w of the branch 18 lies in the range 0.2 mm to 3 mm, for example. All of the branches 18 can be of the same length within a row. In a variant not shown, the lengths of the branches 18 vary, e.g., taking two alternating values along the axis X.

The applicator elements 13 can include a main portion 22 having a longitudinal axis that extends substantially parallel to the adjacent face 19 of the core 11, as in the embodiment in FIG. 5.

The portion 22 that is rectilinear for example, can extend over a length t for example, that corresponds to more than half the total length l of the applicator element, for example. By way of example, the total length l is greater than or equal to 1.5 mm, the length t of the main portion 22 being greater than the sum of the width of a face 19 and of the length of a branch 18, for example.

The underlying face 19 extends over a length f which is strictly inferior to the length t of the main portion 22 of the applicator element extending substantially parallel to the facing underlying face of the core.

An applicator element 13 can present, in particular over the main portion 22, a width s that is greater than its thickness e, as can be seen in particular in FIG. 3.

Each applicator element 13 can come level with an applicator element of an adjacent row, or it can project beyond it, as shown in FIG. 4. The term "level with" should be understood to mean that a plane that is perpendicular to the longitudinal axis of the applicator element intersects the applicator element of the adjacent row.

The various rows 12 of applicator elements 13 can be disposed relative to one another in such a manner that when the applicator member 10 is observed from the side, e.g., looking along arrow V in FIG. 2, the applicator elements 13 of one row project, by a distance d, beyond the plane K that is tangential to the applicator elements of the adjacent row, as shown in FIG. 4, thereby conferring reinforced combing action to the applicator member 10. By way of example, the projecting length d can be at least 0.5 mm.

In the embodiment shown in FIGS. 1 to 5, the applicator member has four faces 100 that are used for application, each face being defined by at least portions of the applicator elements of a first row, specifically the main portions 22, and the ends 61 of the applicator elements of a second row, adjacent to the base of the applicator elements of the first row.

In order to apply the composition P, the user begins by removing the applicator 3 from the receptacle 2, and can then bring the applicator elements 13 of a row into contact with the eyelashes by positioning the applicator elements 13, e.g., so that their main portions 22 are substantially tangential to the eyelashes.

The eyelashes can also be engaged between the end portions 61 of the applicator elements 13 of an adjacent row.

Naturally, various modifications can be applied to the applicator member 10 without going beyond the ambit of the present invention.

By way of example, at least some applicator elements 13 can include a curved portion 46 between the bend portion 17, via which they are connected to the core 11, and their free end 45, as shown in FIG. 6. The curved portion 46 can be convex beside the core 11, e.g., optionally matching the shape of an arc of a circle.

FIG. 6 also shows the possibility of the applicator member 10 presenting applicator elements 13 having different shapes. All of the applicator elements 13 of a single row can optionally have the same shape, and optionally identical dimensions.

FIG. 6 shows an eyelash H coming into contact with an application face of the applicator member.

It can be seen that the eyelash can be covered with composition on coming into contact with the applicator elements that are substantially parallel thereto, and can be separated by the applicator elements of the adjacent row that have ends that are substantially perpendicular thereto.

Figure 7:
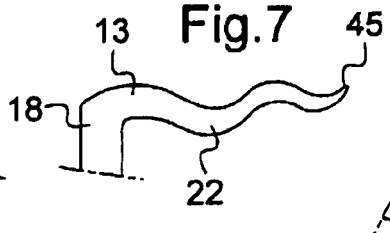
FIG. 7 is a view similar to FIG. 5 showing a variant embodiment.

FIG. 7 shows the possibility of at least one applicator element 13 presenting an undulating shape, in particular over its main portion 22 that extends between the bend portion 17 and its free end 45.

The applicator elements can have free ends that present various shapes. The applicator elements 13 may be subjected to a treatment for modifying their shape and/or their surface state, e.g., a grinding or a hot-melting treatment.

Figure 8:
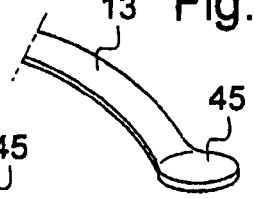
FIGS. 8 to 11 show variant embodiments of the applicator elements.
Figure 9:
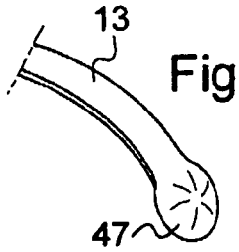
Figure 10:
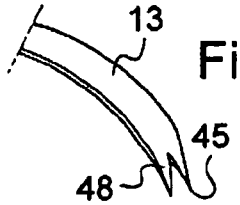

FIG. 8 shows the possibility of at least one applicator element 13 having an end with a bend, FIG. 9 shows the possibility of at least one applicator element 13 having a wide end, e.g., in the form of a bead 47, and FIG. 10 shows the possibility of at least one applicator element 13 having an end presenting a fork 48.

Figure 11:
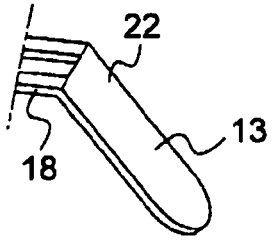

At least one applicator element 13 can be perforated. By way of example, it may have a perforation that is situated in the bend portion 17, as shown in FIG. 11, or else in the main portion 22.

The envelope surface of the applicator member 10 can present various shapes, e.g., being, over at least a fraction of its length, cylindrical and having a cross-section that is optionally circular, or cylindrical and having a cross-section that is polygonal.

Figure 13:
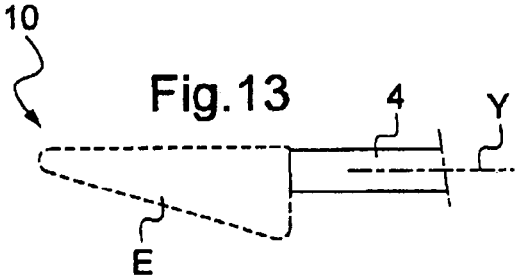
FIGS. 13 to 15 are diagrammatic side views of envelope surfaces of variant applicator members.
Figure 14:
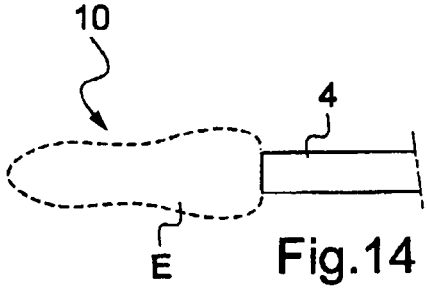

FIG. 13 shows the possibility of the envelope surface E of the applicator member 10 presenting a shape that is not symmetrical relative to the longitudinal axis Y of the distal portion of the stem 4, e.g., straight on one side and oblique on the opposite side, and FIG. 14 shows the possibility of the envelope surface E presenting a cross-section that is not constant, e.g., peanut shaped, or some other shape.

The envelope circle C can present a radius that varies as a function of the position along the longitudinal axis X. Thus, the length of the applicator elements 13 can vary along the longitudinal axis X while remaining greater than the radius of the envelope circle passing via the free end of the applicator element under consideration, for example.

Figure 15:
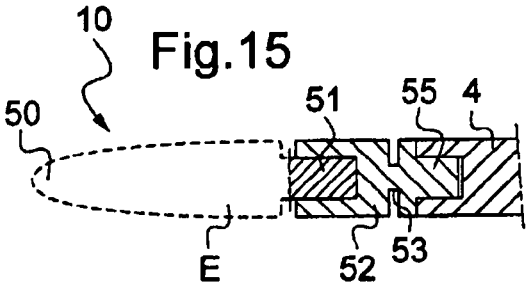

In FIG. 15, it can be seen that the applicator member 10 can include a head 50 that can be of shape that is pyramidal, frustoconical, or conical, for example.

FIG. 15 also shows the possibility of fastening the applicator member 10 on the stem 4 by means of an applicator member endpiece 51. The endpiece 51 may be engaged in a part 52 including a flexible portion 53 that is suitable for flexing while the applicator member 10 is being used to apply a composition to the eyelashes and/or the eyebrows and/or while the applicator member 10 is being removed from the receptacle 2 containing the composition P.

The part 52 can be fitted on the remainder of the stem 4 by means of an endpiece 55, or, in a variant, the stem 4 is made by molding plastics material integrally with the flexible portion 53.

Figure 12:
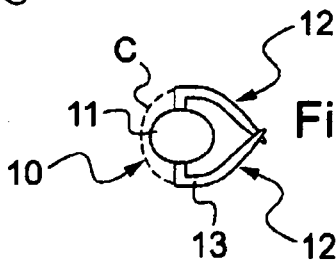
FIG. 12 shows a variant embodiment of the applicator member.

FIG. 12 shows the possibility of applicator elements 13 belonging to different rows 12 crossing one another when the applicator member 10 is observed along its longitudinal axis.

The applicator elements 13 can be of thickness e that is optionally constant.

Where appropriate, the applicator elements 13 can include roughness, and that can increase the quantity of composition that is retained by capillarity on the applicator member 10.

Where appropriate, two consecutive applicator elements 13 of a row 12 can have bases 40 that are touching, the branches 18 widening, e.g., towards the core, so as to form a V-shape between them when the applicator member is observed from the side, looking along arrow V in FIG. 2.

All of the applicator elements 13 can be of the same length l, or, in a variant, can present different lengths. The bend portions 17 can be identical or different.

The applicator elements 13 and/or the core 11 can include flocking.

The gap between two consecutive applicator elements of a row 12 can be of width that is constant or that varies.

The free ends of the applicator elements 13 are preferably finer than their bases.

Wiper members other than the wiper member shown in FIG. 1 can be used, e.g., wiper members including a block of foam or an undulating lip, or wiper members that are adjustable.

By way of example, the applicator of the present disclosure can be used in a packaging and applicator device including a receptacle having at least one movable partition making it possible to force the composition to flow through a chamber containing an applicator member. Such a device makes it possible to mix together a plurality of composition components before loading and/or applying the mixture.

The longitudinal axis X of the applicator member 10 need not be rectilinear.

Figure 16:
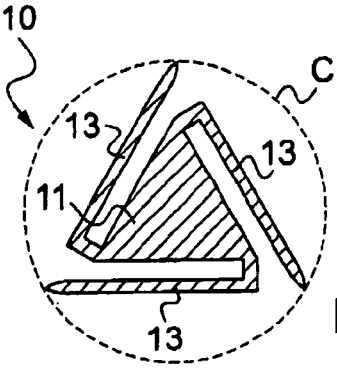

FIG. 16 shows an applicator member having a core 11 that presents a cross-section that is substantially triangular, with three rows 12 of applicator elements 13.

Figure 17:
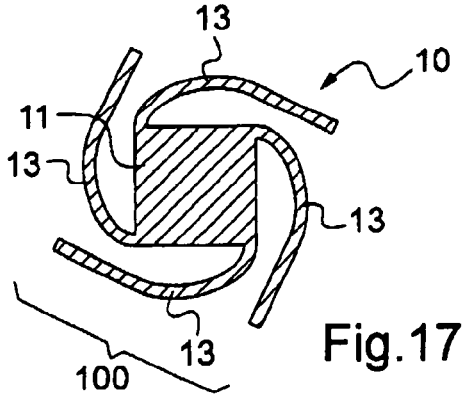

FIG. 17 shows another example of an applicator member 10 in which all of the applicator elements 13 present a curved shape.

FIG. 18 shows the possibility of having an applicator member that includes applicator elements 13 having different lengths $l_1$ and $l_2$ in the example shown. This can result in different projection values $d_1$ and $d_2$ depending on which row of applicator elements is under consideration. In a variant not shown, the applicator elements can also have bend portions having branches 18 of different lengths.

In the variant shown in FIG. 19, the applicator elements 13 have the same length, but the projection values d are different depending on which face of the applicator member is under consideration, because of the shape of the core 11 that is of rectangular cross-section, for example.

FIG. 20 shows an applicator member having a core that has a cross-section that is circular in shape. Rows of applicator elements 13 can be connected to the core with the branches 18 of the bend portions extending substantially tangentially to said core.

The longitudinal axis X of the core need not be rectilinear, as shown in FIG. 21.

The longitudinal axis X of the core can also form an angle with the longitudinal axis Z of the stem, as shown in FIG. 22, the axis X being optionally rectilinear in this event, and the above-mentioned angle lying in the range of 1° to 15°, for example.

The characteristics of the various embodiments shown in the drawings can be combined together within variants not shown.

The core could be hollow so as to receive an insert of different hardness.

The applicator elements could be connected to a wall that is common to the applicator elements, replacing the branches 18, and could be connected perpendicularly to the corresponding face of the core.

The expression "comprising a" should be understood as being synonymous with "comprising at least one" unless specified to the contrary.

Although the present disclosure herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the present invention.

What is claimed is:

1. An applicator for applying a composition to eyelashes and/or eyebrows, the applicator comprising:

an applicator member comprising a core defining faces, each face having a width and a length, the width being shorter than the length; and rows of applicator elements connected to the core, the rows of applicator elements comprising at least a first row comprising applicator elements connected to the core via a respective bend portion, the applicator elements in the first row comprising at least one applicator element comprising a main portion extending substantially parallel to a face of the core underlying and facing the main portion, said main portion being situated between the bend portion and a free end of the at least one applicator element and extending at least over an entire width of the face.

2. The applicator according to claim 1, wherein the applicator member comprises at least two faces configured to be used for application of the composition, each face of the applicator member being defined by at least portions of applicator elements of one row, and by at least free ends of applicator elements of another row.

3. The applicator according to claim 1, wherein the core has a cross-section having a substantially polygonal shape, said main portion of said at least one applicator element being substantially rectilinear.

4. The applicator according to claim 1, wherein each of the bend portions of a plurality of the applicator elements in the first row defines a right angle.

5. The applicator according to claim 1, wherein at least a first applicator element of one row is situated level with or extends beyond a second applicator element of another row, and wherein a longitudinal axis of the first applicator element is perpendicular to a plane intersecting the second applicator element without passing through the core.

6. The applicator according to claim 1, wherein each applicator element of one of the rows has a portion extending substantially parallel to a face of the core underlying and facing the portion.

7. The applicator according to claim 1, wherein at least one of the applicator elements extends at least partially around the core and has a free end spaced apart from said core by a distance that is less than or equal to one fourth of the length of the at least one applicator element extending at least partially around the core, the distance being measured in a plane perpendicular to a longitudinal axis of the applicator member.

8. The applicator according to claim 1, wherein the applicator member has, over at least a fraction of its length, a cross-section defining an envelope circle circumscribing the applicator member, at least one applicator element along said fraction having a length greater than or equal to the radius of the envelope circle, and having a free end spaced apart from the core by a distance that is less than or equal to half the radius of the envelope circle.

9. The applicator according to claim 8, comprising at least one applicator element that, all along its length other than at its connection to the core, is spaced apart from the core by a distance that is not greater than half the radius of the envelope circle.

10. The applicator according to claim 1, wherein the core is symmetric about an axis of symmetry coinciding with a longitudinal axis of the core.

11. The applicator according to claim 1, wherein the core has a longitudinal axis that is rectilinear.

12. The applicator according to claim 1, comprising at least three rows of applicator elements.

13. The applicator according to claim 1, wherein the applicator elements of at least two rows extend at least partially around the longitudinal axis of the core in the same direction.

14. The applicator according to claim 1, comprising at least three rows of applicator elements, the applicator elements of the rows extending at least partially around the longitudinal axis of the core in the same direction.

15. The applicator according to claim 1, wherein the applicator member has a distal end that tapers.

16. The applicator according to claim 1, wherein the bend portion comprises a branch connected to the core, the branch extending over a distance lying in the range of 0.2 mm to 3 mm.

17. The applicator according to claim 1, further comprising at least one applicator element being connected substantially perpendicularly to a corresponding face of the core.

18. The applicator according to claim 1, wherein each applicator element of one of the rows has a portion extending substantially parallel to a face of the core underlying and facing the portion and having a length greater than or equal to one fourth of the applicator element's total length.

19. The applicator according to claim 1, wherein said main portion of the applicator element has a length greater than a dimension of the face of the core underlying and facing the main portion.

20. The applicator according to claim 1, comprising a row comprising at least six applicator elements.

21. The applicator according to claim 1, comprising at least one applicator element molded integrally with the core and being formed of the same material as the core.

22. The applicator according to claim 21, wherein all of the applicator elements are molded integrally with the core.

23. The applicator according to claim 1, wherein the applicator member defines an envelope surface having a substantially constant cross-section over at least half the length of a portion of the applicator member including the applicator elements.

24. The applicator according to claim 1, wherein the length of at least one of the applicator elements is greater than or equal to 1.5 mm.

25. The applicator according to claim 24, wherein the length of at least one applicator element lies in a range of 1.5 mm to 10 mm.

26. The applicator according to claim 1, wherein when the applicator member is observed from a side, perpendicularly to its longitudinal axis, at least one applicator element belonging to a row of applicator elements projects beyond at least one applicator element of an adjacent row of applicator elements.

27. The applicator according to claim 26, wherein the projection extends over a distance of at least 0.5 mm.

28. The applicator according to claim 1, comprising at least one applicator element extending angularly about the longitudinal axis of the core over an angle of at least 45°.

29. The applicator according to claim 1, further comprising at least one applicator element being perforated and/or having an undulating shape, and/or having a free end that is bent, abraded, or wide.

30. The applicator according to claim 1, comprising at least two applicator elements crossing one another.

31. The applicator according to claim 1, wherein the applicator member is connected to a stem.

32. The applicator according to claim 31, wherein the stem being connected to a handle is configured to close a receptacle containing the composition for application.

33. The applicator according to claim 1, wherein at least one applicator element extends at least partially around the core and its entire length, other than at its connection to the core, is spaced apart from said core by a distance that is less than or equal to one fourth of its length.

34. The applicator according to claim 1, comprising magnetizable particles.

35. The applicator according to claim 1, wherein the applicator is formed of natural plant products.

36. The applicator according to claim 1, wherein the applicator is flocked.

37. A packaging and applicator device, comprising: the applicator as defined in claim 1; and a composition for application to the eyelashes and/or the eyebrows.

38. The device according to claim 37, further comprising a receptacle comprising a wiper member, the composition being contained in the receptacle.

39. A method of applying makeup to eyelashes and/or eyebrows, the method comprising bringing the applicator as defined in claim 1 into contact with the eyelashes and/or eyebrows, wherein the method further comprises at least one of arranging the application so at least one applicator element extends tangentially relative to at least one eyelash or eyebrow, and placing the eyelashes and/or eyebrows in contact with at least two applicator elements belonging to adjacent rows.

40. The applicator according to claim 1, wherein the applicator elements are connected to an edge of the core.

* * * * *